United States Patent [19]

Kondo et al.

[11] Patent Number: 4,924,790

[45] Date of Patent: May 15, 1990

[54] SEWING MACHINE WITH A CLOTH-EDGE DETECTOR

[75] Inventors: Ikuzo Kondo, Chita; Tsutomu Makihara, Nagoya, both of Japan

[73] Assignee: Brother Kogyo Kabushiki Kaisha, Aichi, Japan

[21] Appl. No.: 311,625

[22] Filed: Feb. 16, 1989

[30] Foreign Application Priority Data

Feb. 22, 1988 [JP] Japan ..... 63-38894

[51] Int. Cl.[5] ..... D05B 69/18

[52] U.S. Cl. ..... 112/272; 112/277; 250/561

[58] Field of Search ..... 112/272, 275, 277, 121.11, 112/104, 303, 271; 250/202, 548, 557, 559, 561, 571

[56] References Cited

U.S. PATENT DOCUMENTS

| | | | |
|---|---|---|---|
| 4,565,140 | 1/1986 | Martell et al. | 112/272 X |
| 4,574,719 | 3/1986 | Balke | 112/272 |
| 4,696,246 | 9/1987 | Rohr et al. | 112/272 |

FOREIGN PATENT DOCUMENTS

| | | |
|---|---|---|
| 58-50487 | 3/1983 | Japan . |
| 60-85386 | 5/1985 | Japan . |
| 1399256 | 7/1975 | United Kingdom . |

*Primary Examiner*—Peter Nerbun
*Attorney, Agent, or Firm*—Oliff & Berridge

[57] ABSTRACT

A sewing machine with a cloth-edge detector has a light source for casting light on a sensing point on a cloth, and a light receiver for generating an intensity signal according to the intensity of the received light. Before sewing, a reference signal is set at an average of two intensity signals that are gauged before and after a cloth edge. The cloth edge can be detected by comparing the intensity signal from the light receiver with the reference signal.

10 Claims, 9 Drawing Sheets

SEWING MACHINE WITH A CLOTH-EDGE DETECTOR

BACKGROUND OF THE INVENTION

The present invention relates to a sewing machine with a cloth-edge detector for detecting a border of the overlap of cloths or an edge of a single cloth.

In one prior-art cloth-edge detector, the sensitivity in detecting a cloth-edge is adjusted with a manually operated controller. As shown in FIG. 8, the detector has a photo-transistor P1 that applies a voltage according to the intensity of light it receives through a cloth or cloths to a negative terminal of a comparator C1 via a filter circuit F1 and an amplifier A1. The voltage at the negative terminal is compared with a preset reference voltage Vref at the positive terminal in the comparator C1 to distinguish the number of cloths. Before sewing, the collector current that flows through the photo-transistor P1 is adjusted with a manually controlled variable resistor R1, so that the detector detects a cloth-edge by distinguishing a thin part from a thick part while sewing the cloths.

It is, however, difficult and inconvenient to adjust the variable resistor R1 by hand. To remove this disadvantage, Japanese Published Unexamined Patent Application No. S60-85386 and S58-50487 discloses a sewing machine with an automatically adjusted cloth-edge detector. As shown in FIG. 9, this cloth-edge detector has a variable-voltage generator VR1 (or a digital-to-analogue converter) controlled by a microcomputer. A voltage V2 (FIG. 7) for one cloth is first detected. Then, the reference voltage V6 is set slightly lower than the voltage V2, and the variable-voltage generator VR1 applies the reference voltage V6 to the positive terminal of a comparator C2. While sewing, the cloth-edge detector distinguishes the number of cloths to detect a cloth-edge. In FIG. 9, the photo-transistor P2, filter circuit F2, and amplifier A2 are similar to those illustrated in FIG. 8, and a resistor R2 determines the collector current.

Such an automatically adjusted cloth-edge detector still has problems. Because the reference voltage V6 is set lower than the voltage V2 by a small amount, the reference voltage V6 may be set too close to the voltage V2 for a single cloth or too far from the voltage V1 for the overlapping cloths. Moreover, an uneven weave of a cloth could cause the irregularity in the strength of the light that reaches the light receiver past the cloth. If the reference voltage V6 is set for the light passing through a loose weave of the cloth, the detector would mistake a tight weave as an overlap of the cloths. The prior-art detector, therefore, might misjudge a cloth-edge when the weave of the cloth is uneven.

SUMMARY OF THE INVENTION

The present invention solves these problems by providing a sewing machine with an accurate cloth-edge detector that detects an edge of a cloth regardless of unevenness in the weave of the cloth.

As illustrated in FIG. 1, the present invention provides a sewing machine for sewing a cloth or a plurality of overlapping cloths. The sewing machine comprises: a light source M1 for casting light on a preset sensing point in a path of the cloth or cloths; a light receiver M2 for receiving the light coming from the light source M1 through the sensing point, and for generating an intensity signal corresponding to the intensity of the light; and an edge detecting means M4 for detecting a cloth edge passing the sensing point during sewing by comparing the intensity signal from the light receiver M2 with a reference signal. The sewing machine further comprises a reference determination means M3, used before sewing, for receiving two intensity signals from the light receiver M2, respectively before and after said cloth edge passes the sensing point, and for determining the reference signal based on the two intensity signals.

Before sewing any cloths, the reference determination means M3 determines a reference signal based on two signals corresponding to points located before and after an edge of the cloth, respectively. While sewing, the edge detecting means M4 detects an edge of the cloth by comparing the signals from the light receiver M2 with the reference signal. Because the value of the reference signal is a mean value of the two signals, the detecting means can accurately detect a cloth edge without making any misjudgment even if the weave of the cloth is uneven.

DETAILED DESCRIPTION OF AN EMBODIMENT

Figure 1:
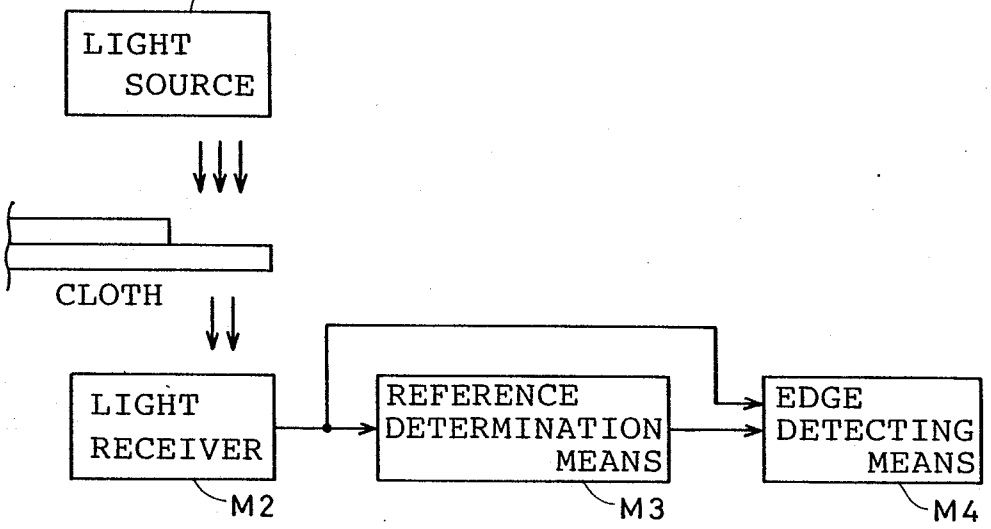
FIG. 1 is a schematic block diagram illustrating a basic design of a cloth-edge detector of the present invention.
Figure 2:
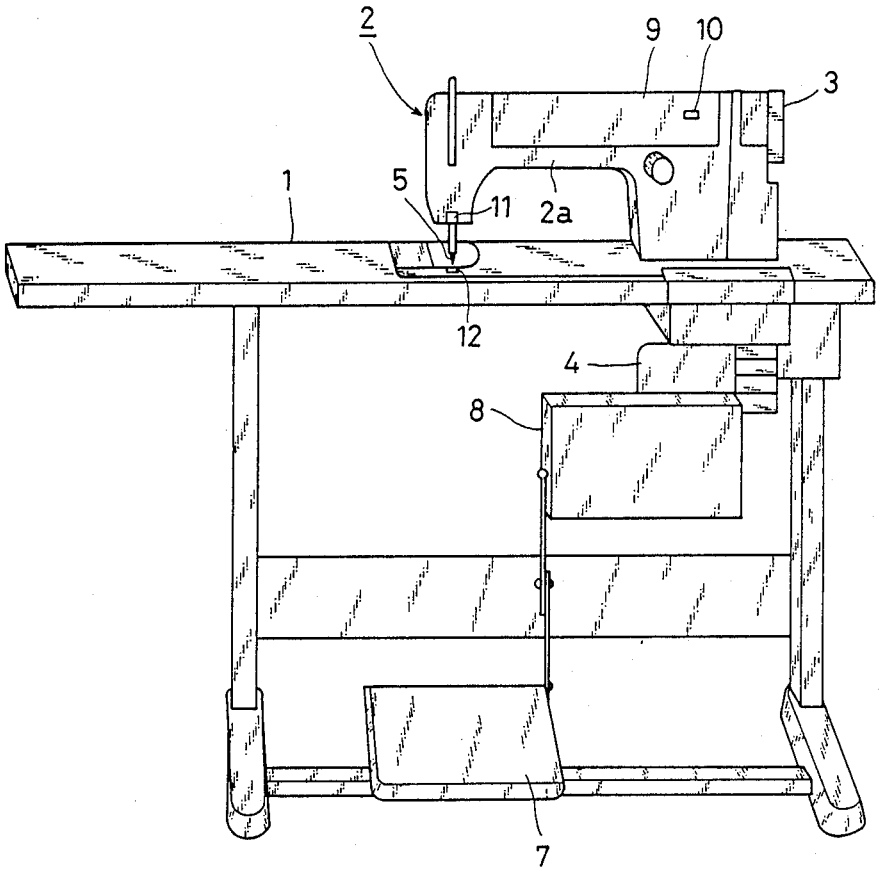
FIG. 2 is a general perspective view of a sewing machine with a cloth-edge detector as an embodiment of the present invention.

One embodiment of the invention is a sewing machine, as shown in FIG. 2, with a body 2 mounted on a table 1. A pulley 3 is fixed at an end of an arm shaft which rotates in the body 2 on the right-hand side of the drawing, and it connects with a main motor 4 below the table 1 via a belt (not shown). A needle-position sensor 6 (FIG. 4) is placed by the pulley 3 to detect a rotational angle of the arm shaft corresponding to the vertical position of a needle 5. As described later, an electronic control unit contained in a control box 8 drives the motor 4 in response to pressing of a pedal 7 below the table 1. An arm **2*a* of the body 2 has an operation panel 9 with various switches including a reference-voltage calibration switch 10** which is described later.

Figure 3:
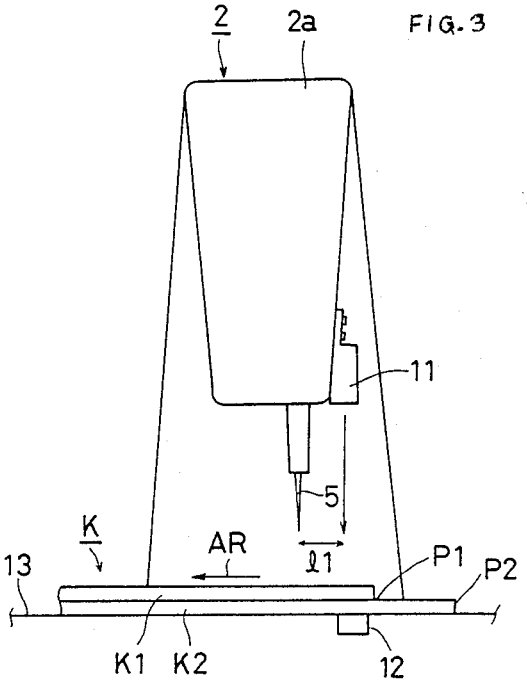
FIG. 3 is a side view of the sewing end of the sewing machine.

As shown in FIG. 3, a light source 11 using a light-emitting diode is attached to a front face of the arm **2*a*. A light receiver 12 containing a photo-transistor 12*a* (FIG. 4) is embedded in a bed 13 just below the light source 11. The needle 5 cooperates with a known rotating hook in the bed 13 to sew a cloth K. The light source 11** casts light on a point of the cloth K two centimeters (l1 in FIG. 3) upstream of the sewing point of the needle 5.

Figure 4:
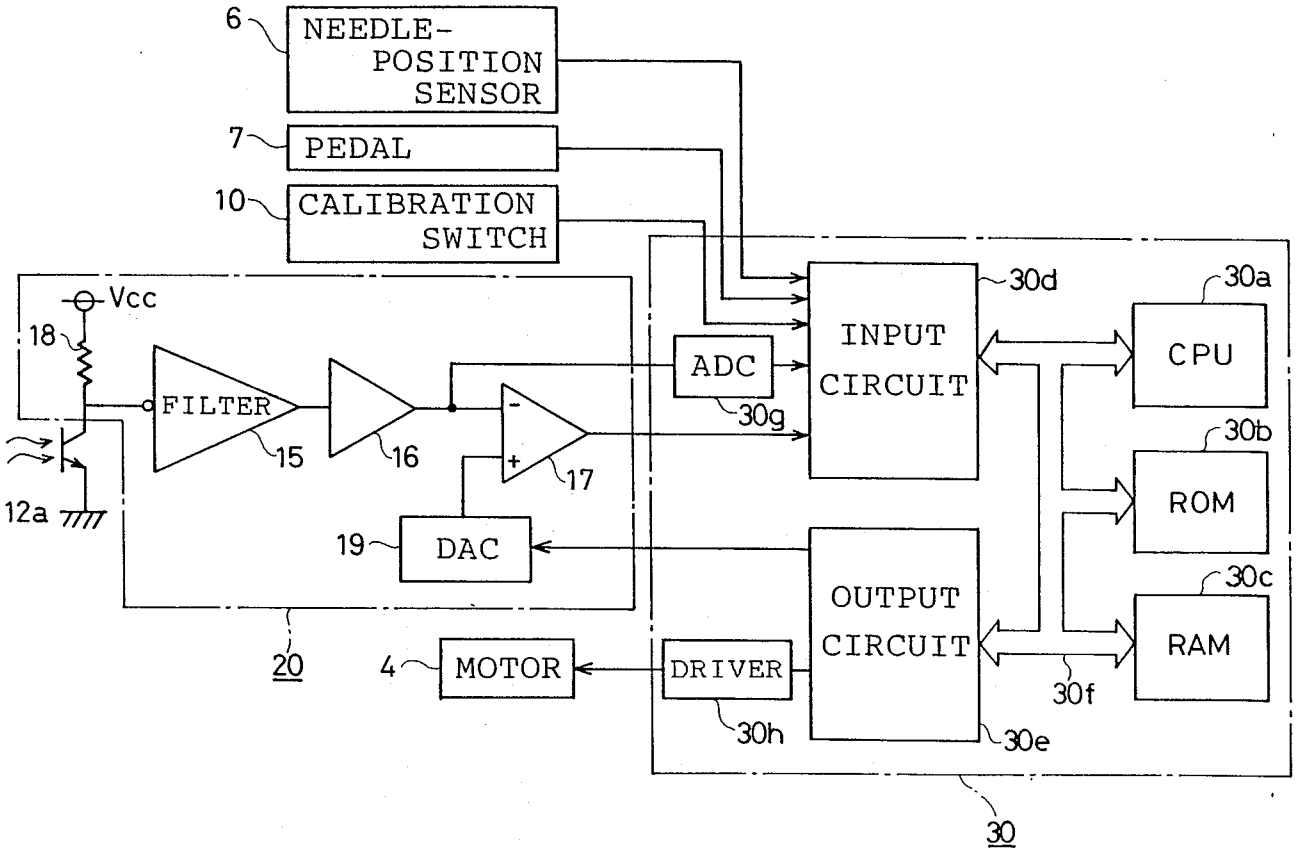
FIG. 4 is an electrical circuit diagram for the embodiment.

The electrical circuit for the cloth-edge detector of the present embodiment is explained using FIG. 4. The photo-transistor 12*a* has its emitter grounded and its collector connected to the negative input terminal of a comparator 17 via a noise-filter circuit 15 and an amplifier 16. The collector also connects via a resistor 18 to a power source that supplies a constant voltage Vcc. The photo-transistor 12*a*, therefore, provides the negative input terminal of the comparator 17 voltage proportional to the intensity of the received light. The positive input terminal of the comparator 17 is connected with a variable-voltage generator (or a digital-to-analogue converter—a DAC) 19. The filter circuit 15, amplifier 16, comparator 17, variable-voltage generator 19 compose a sensitivity calibrator 20.

An electronic control unit (ECU) 30 contained in the control box 8 is a microcomputer mainly comprising a known CPU 30*a*, ROM 30*b*, and RAM 30*c* that are connected to an input circuit 30*d* and an output circuit 30*e* via an interconnecting bus 30*f*. The ECU 30 also includes an analogue-to-digital converter (ADC) 30*g* and a motor driver 30*h*.

The input circuit 30*d* is connected with the needle-position sensor 6, the pedal 7, and the calibration switch 10. The input circuit 30*d* is also connected with the output terminal of the amplifier 16 via the ADC 30*g* and with the output terminal of the comparator 17. The output circuit 30*e* is connected to the DAC 19 and to the main motor 4 via the driver 30*h*.

Figure 5:
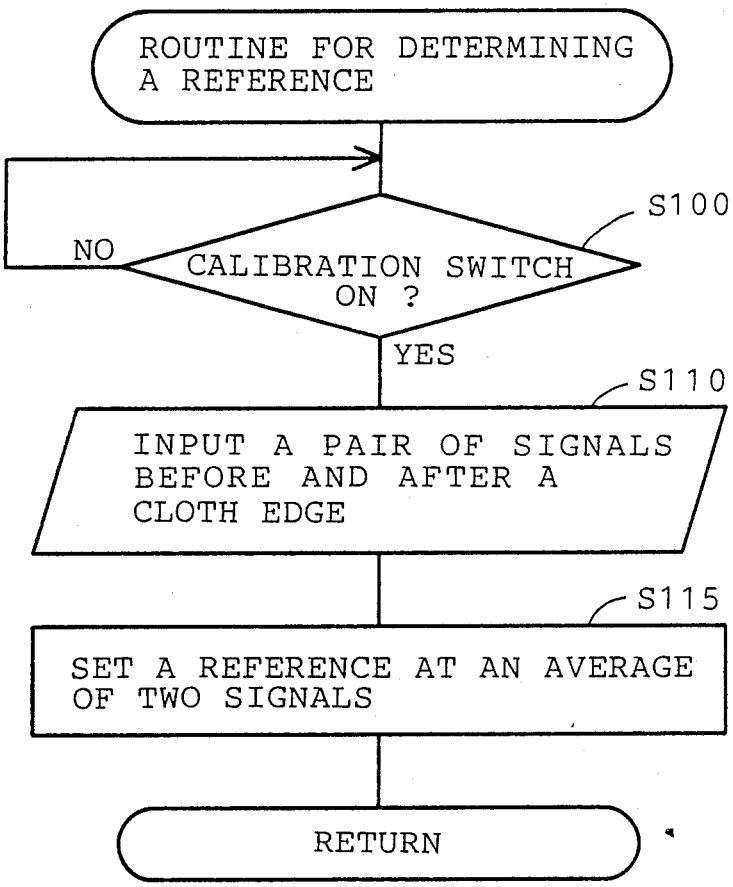
FIG. 5 is a flowchart showing a routine for setting the reference voltage.
Figure 6:
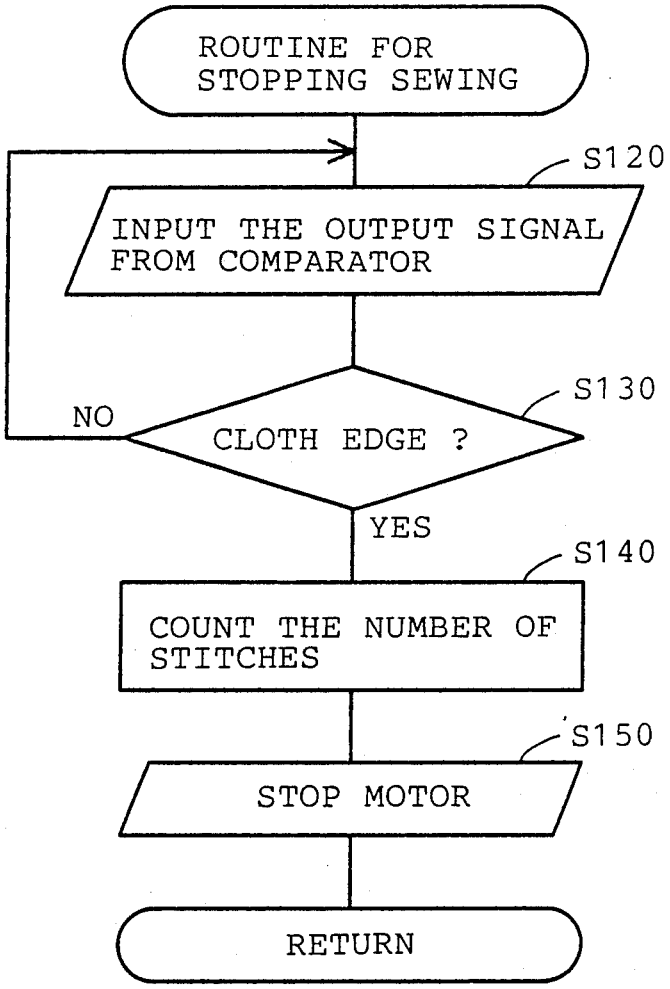
FIG. 6 is a flowchart showing a routine for stopping sewing.

The process for detecting a cloth edge and stopping sewing is explained using the flowcharts in FIGS. 5 and 6: FIG. 5 shows a process for setting a reference voltage used in the cloth-edge detector, and FIG. 6 shows a process for stopping sewing when a cloth edge is detected.

The routine in FIG. 5 starts from step 100 when the operator turns on the calibration switch 10 before sewing. Then, the operator moves cloths K, including the upper cloth K1 and the lower cloth K2 on the bed 13, in the direction AR as shown in FIG. 3 so that an overlapping edge P1 passes through the sensing point between the light source 11 and the light receiver 12. At step 110, the CPU 30*a* receives voltage signals via the amplifier 16 and the ADC 30*g*.

The voltages greatly differ between the upstream and downstream portions of the overlapping edge P1. If the cloths K1 and K2 overlap, the photo-transistor 12*a* receives the light of lower intensity, and the CPU 30*a* accordingly receives a low voltage V1 (see FIG. 7). If the cloth K1 does not overlap the cloth K2, the photo-transistor 12*a* receives the light of higher intensity, and the CPU 30*a* receives a voltage V2 higher than V1.

After step S110 where these two voltage signals V1 and V2 are determined before and after the overlapping edge P1, respectively, a reference voltage V4 is determined at step 115 based on V1 and V2. In this embodiment, the reference voltage V4 is an average of the voltages V1 and V2 ($V4=(V1+V2)/2$). The routine for setting a reference voltage ends after step 115.

When the pedal 7 is pressed and the motor 4 runs, the routine shown in FIG. 6 is executed at short, preset intervals for stopping sewing using the cloth-edge detector. When this routine starts, the CPU 30*a* reads an output signal from the comparator 17 via the input circuit 30*d* at step S120. Before this processing, the CPU 30*a* sends a digital signal corresponding to the reference voltage V4 to the DAC 19 via the output circuit 30*e*, so that DAC 19 applies the reference voltage V4 to the positive input terminal of the comparator 17.

As the voltage from the amplifier 16 changes from V1 to V2 after the overlapping edge P1, the output signal from the comparator 17 switches from high level to low level. Under this condition, it is determined at step S130 that the overlapping edge P1 has reached the point two centimeters upstream of the sewing point.

When the overlapping edge P1 is detected, the CPU 30*a* starts counting the number of stitches based on signals from the needle-position sensor 6 at step S140. After the predetermined number of stitches is made to reach the overlapping edge P1, the motor 4 stops sewing at step S150, and the routine ends.

Figure 7:
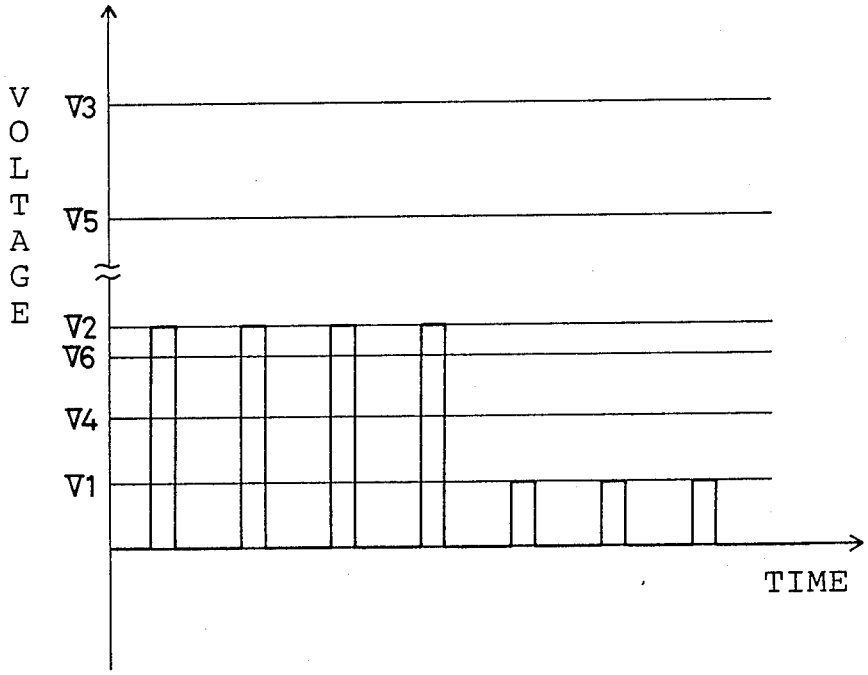
FIG. 7 is a graph showing the reference voltage and voltages detected at different plies on the cloth.
Figure 8:
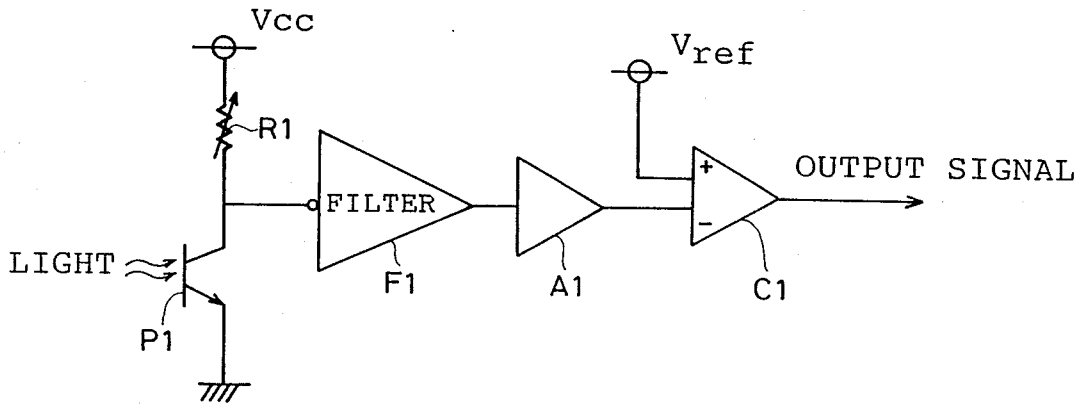
FIG. 8 PRIOR ART
FIG. 8 is a circuit diagram for the manually adjusted detection system of prior art.
Figure 9:
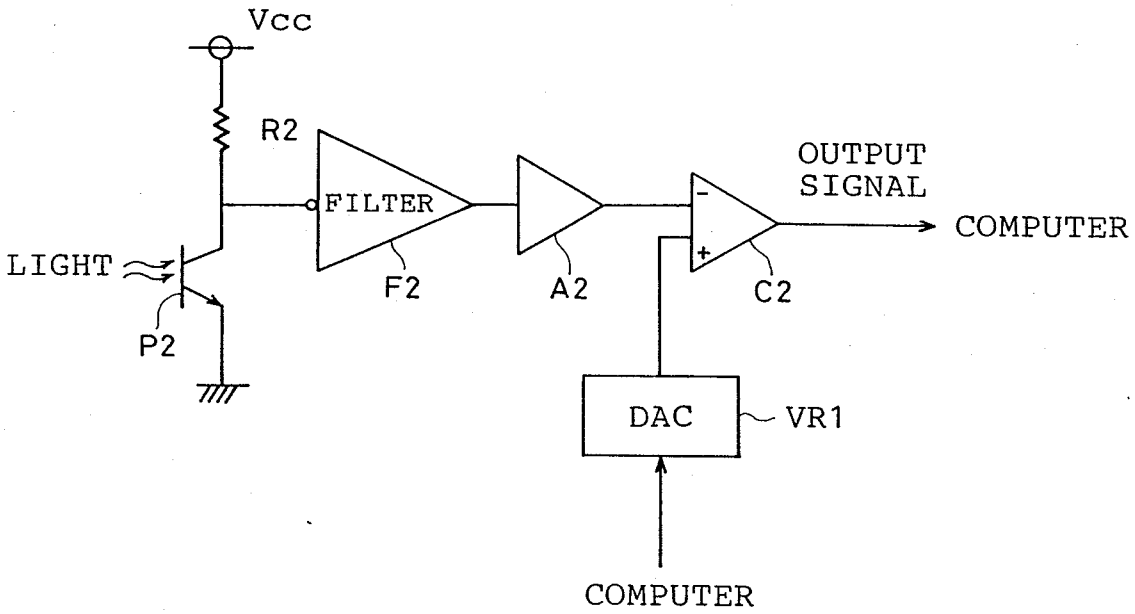
FIG. 9 PRIOR ART
FIG. 9 is a circuit diagram for the automatically adjusted detection system of prior art.

To detect a cloth edge P2 of a single cloth K2 (see FIG. 3), two voltages before and after the cloth edge P2 are gauged before sewing the cloth K2, so that the CPU 30*a* receives two different signals corresponding to these two voltages (steps 100 and 110 in FIG. 5). In FIG. 7, voltage V2 is a value in the case where the cloth K2 interrupts the light from the light source 11 to the light receiver 12. Voltage V3 is a value in the case where no cloth lies in the way of the light; it is much greater than the voltage V2. After a reference voltage V5 is set in step S115 at an average of V2 and V3 ($V5=(V2+V3)/2$), the CPU 30*a* executes the routine in FIG. 6 to detect the cloth edge P2 and to stop sewing.

Because the reference voltage V4 for detecting the overlapping edge P1 is an average of the voltages V1 and V2, which are detected before and after the overlapping edge P1, the reference voltage V4 is not biased to either of the two voltages V1 and V2. Similarly, the reference voltage V5 for detecting the cloth edge P2 is an average of the voltages V2 and V3 and it is not biased to either of them. The edge-detecting system of the present embodiment, therefore, can accurately detect an overlapping edge P1 and a cloth edge P2 without making any misjudgment because of an uneven weave in the cloth K.

The present invention is not limited to the abovedescribed embodiment. For example, the ADC 30*g* could be eliminated. Alternatively, the CPU 30*a* could detect the analogue output of the amplifier 16 by changing the output of the DAC 19 rapidly for each photo-sensing point while sensing, so that the output V of the amplifier 16 could be determined by the output of the DAC 19 at the inflection point of the output of the comparator 17.

What is claimed is:

1. A sewing machine for sewing a cloth or a plurality of overlapping cloths comprising:

a light source for casting light on a preset sensing point in a path of the cloth or cloths, a light receiver for receiving the light coming from the light source through the sensing point, and for generating an intensity signal corresponding to the intensity of the light, and an edge-detecting means for detecting a cloth edge passing the sensing point during sewing by comparing the intensity signal from the light receiver with a reference signal, the cloth edge being either a free edge of one cloth or an overlapping edge of a plurality of cloths, wherein the sewing machine further comprises:

a reference determination means, used before sewing, for receiving two intensity signals from the light receiver, respectively before and after the cloth edge passes the sensing point, and for determining the reference signal based on the two intensity signals.

2. The sewing machine, as in claim 1, wherein the value of the reference signal is the average value of the two intensity signals.

3. The sewing machine, as in claim 2, wherein:

the light receiver comprises a photo-transistor for generating a voltage corresponding to the intensity of the light;

the reference determination means comprises calculation means for calculating an average of the two voltages received from the photo-transistor, and a variable-voltage generator for generating a reference voltage equal to the average; and the edge detecting means comprises a comparator for comparing the voltage generated by the photo-transistor with the reference voltage from the variable-voltage generator.

4. The sewing machine as defined in claim 1, further comprising a stopping means for stopping sewing a preset period after a cloth edge is detected by the edge detecting means.

5. The sewing machine as defined in claim 1, wherein the reference determination means further comprises memory means for storing the reference signal during sewing.

6. A sewing machine for sewing a cloth or a plurality of overlapping cloths comprising:

a light source for casting light on a preset sensing point in a path of the cloth or cloths, a light receiver for receiving the light coming from the light source through the sensing point, and for generating an intensity signal corresponding to the intensity of the light, and an edge-detecting means for detecting a cloth edge passing the sensing point during sewing by comparing the intensity signal from the light receiver with a reference signal, the cloth edge being either a free edge of one cloth or an overlapping edge of a plurality of cloths, wherein the sewing machine further comprises:

a reference determination means for receiving two intensity signals from said light receiver and for determining said reference signal based on said two intensity signals, said two intensity signals being generated by passing a cloth edge through said sensing point prior to a sewing operation and being representative of intensity signals generated before and after, respectively, an edge passes through the sensing point.

7. The sewing machine, as in claim 6, wherein the value of the reference signal is the average value of the two intensity signals.

8. The sewing machine, as in claim 7, wherein:

the light receiver comprises a photo-transistor for generating a voltage corresponding to the intensity of the light;

the reference determination means comprises calculation means for calculating an average of the two voltages received from the photo-transistor, and a variable-voltage generator for generating a reference voltage equal to the average; and the edge detecting means comprises a comparator for comparing the voltage generated by the photo-transistor with the reference voltage from the variable-voltage generator.

9. The sewing machine as defined in claim 6, further comprising a stopping means for stopping sewing a preset period after a cloth edge is detected by the edge detecting means.

10. The sewing machine as defined in claim 6 wherein the reference determination means further comprises memory means for storing the reference signal during sewing.

* * * * *